US009458596B2

(12) United States Patent
Jones

(10) Patent No.: US 9,458,596 B2
(45) Date of Patent: Oct. 4, 2016

(54) CONDUIT CARTRIDGE

(71) Applicant: Harnischfeger Technologies, Inc., Wilmington (DE)

(72) Inventor: Christopher S. Jones, Milwaukee, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 202 days.

(21) Appl. No.: 14/045,744

(22) Filed: Oct. 3, 2013

(65) Prior Publication Data

US 2014/0099179 A1 Apr. 10, 2014

Related U.S. Application Data

(60) Provisional application No. 61/709,738, filed on Oct. 4, 2012.

(51) Int. Cl.

| | |
|---|---|
| ***E02F 3/30*** | (2006.01) |
| ***E02F 3/46*** | (2006.01) |
| ***E02F 3/42*** | (2006.01) |
| ***E02F 3/36*** | (2006.01) |
| ***E02F 9/22*** | (2006.01) |

(52) U.S. Cl.

CPC ..... *E02F 3/36* (2013.01); *E02F 3/304* (2013.01); *E02F 3/306* (2013.01); *E02F 3/425* (2013.01); *E02F 3/46* (2013.01); *E02F 9/2275* (2013.01); *E02F 3/307* (2013.01); *E02F 3/308* (2013.01)

(58) Field of Classification Search

CPC ..... E02F 3/46; E02F 3/30; E02F 3/301; E02F 3/302; E02F 3/303; E02F 3/304; E02F 3/305; E02F 3/306; E02F 3/307; E02F 3/308; E02F 3/309; E02F 3/28; E02F 3/283; E02F 3/286; E02F 3/425; E02F 9/2275

USPC ..... 414/685, 718; 37/395, 396, 397, 398, 37/399; 248/68.1; 180/53.8; 137/899, 137/355.24; 212/175

See application file for complete search history.

(56) References Cited

U.S. PATENT DOCUMENTS

| | | | | |
|---|---|---|---|---|
| 3,628,675 | A * | 12/1971 | Balogh | A01G 17/16 212/231 |
| 4,276,918 | A | 7/1981 | Sigouin | |
| 5,131,816 | A * | 7/1992 | Brown et al. | 417/2 |
| 2012/0076628 | A1* | 3/2012 | Gilmore | E02F 9/2267 414/687 |

* cited by examiner

*Primary Examiner* — Keith Frisby

(74) *Attorney, Agent, or Firm* — Michael Best & Friedrich LLP

(57) ABSTRACT

An industrial machine includes a frame, an elongated member, an attachment, a plurality of fluid lines, and a cartridge. The frame includes a boom and a fluid source. The elongated member is movably coupled to the boom and includes a first end and a second end. The attachment is pivotably coupled to the first end of the elongated member. The plurality of fluid lines is coupled to the second end of the elongated member and is in fluid communication with the fluid source. The cartridge is removably coupled to the elongated member. The cartridge includes a housing and a plurality of conduits supported within the housing. The conduits are in fluid communication with the plurality of lines.

24 Claims, 5 Drawing Sheets

CONDUIT CARTRIDGE

CROSS-REFERENCE TO RELATED APPLICATION

This application claims the benefit of and priority to U.S. Provisional Patent Application No. 61/709,738, filed Oct. 4, 2012, the entire contents of which is incorporated by reference herein.

BACKGROUND

The present invention relates to industrial machines. Specifically, the present invention relates to a conduit cartridge for an earthmoving machine having an attachment.

Conventional rope shovels include a frame supporting a boom and a handle coupled to the boom for rotational and translational movement. A dipper is attached to the handle and is supported by a cable or rope that passes over an end of the boom. The rope is secured to a bail pivotably coupled to the dipper. During the hoist phase, the rope is reeled in by a hoist drum, lifting the dipper upward through a bank of material and liberating a portion of the material. The orientation of the dipper is generally fixed relative to the handle.

SUMMARY

In one embodiment, the invention provides an industrial machine including a frame, an elongated member, an attachment, a plurality of fluid lines, and a cartridge. The frame includes a boom and a fluid source. The elongated member is movably coupled to the boom and includes a first end and a second end. The attachment is pivotably coupled to the first end of the elongated member. The plurality of fluid lines is coupled to the second end of the elongated member and is in fluid communication with the fluid source. The cartridge is removably coupled to the elongated member. The cartridge includes a housing and a plurality of conduits supported within the housing. The conduits are in fluid communication with the plurality of lines.

In another embodiment, the invention provides a conduit cartridge removably coupled to an industrial machine. The cartridge includes a housing having a first end and a second end, a plurality of conduits, and at least one support member. The plurality of conduits is configured to be in communication with one or more lines positioned adjacent the first end of the housing. The conduits extend between the first end and the second end. The support member is positioned within the housing and supports the conduits relative to one another.

In yet another embodiment, the invention provides an industrial machine including a frame, an elongated member movably coupled to the boom, a plurality of lines, and a cartridge removably coupled to the elongated member. The frame includes a boom. The elongated member includes a first end and a second end and defines a longitudinal axis therebetween. The plurality of lines is coupled to the second end of the elongated member. The cartridge includes a housing and a plurality of conduits supported within the housing. The conduits are in communication with the plurality of lines.

In still another embodiment, the invention provides an attachment support member for an industrial machine. The support member is movably coupled to a frame member. The support member includes an arm having a first end and a second end and a cartridge removably coupled to the arm. The cartridge includes a housing and a plurality of conduits. The housing has a first end and a second end. The conduits extend between the first end and the second end of the housing.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
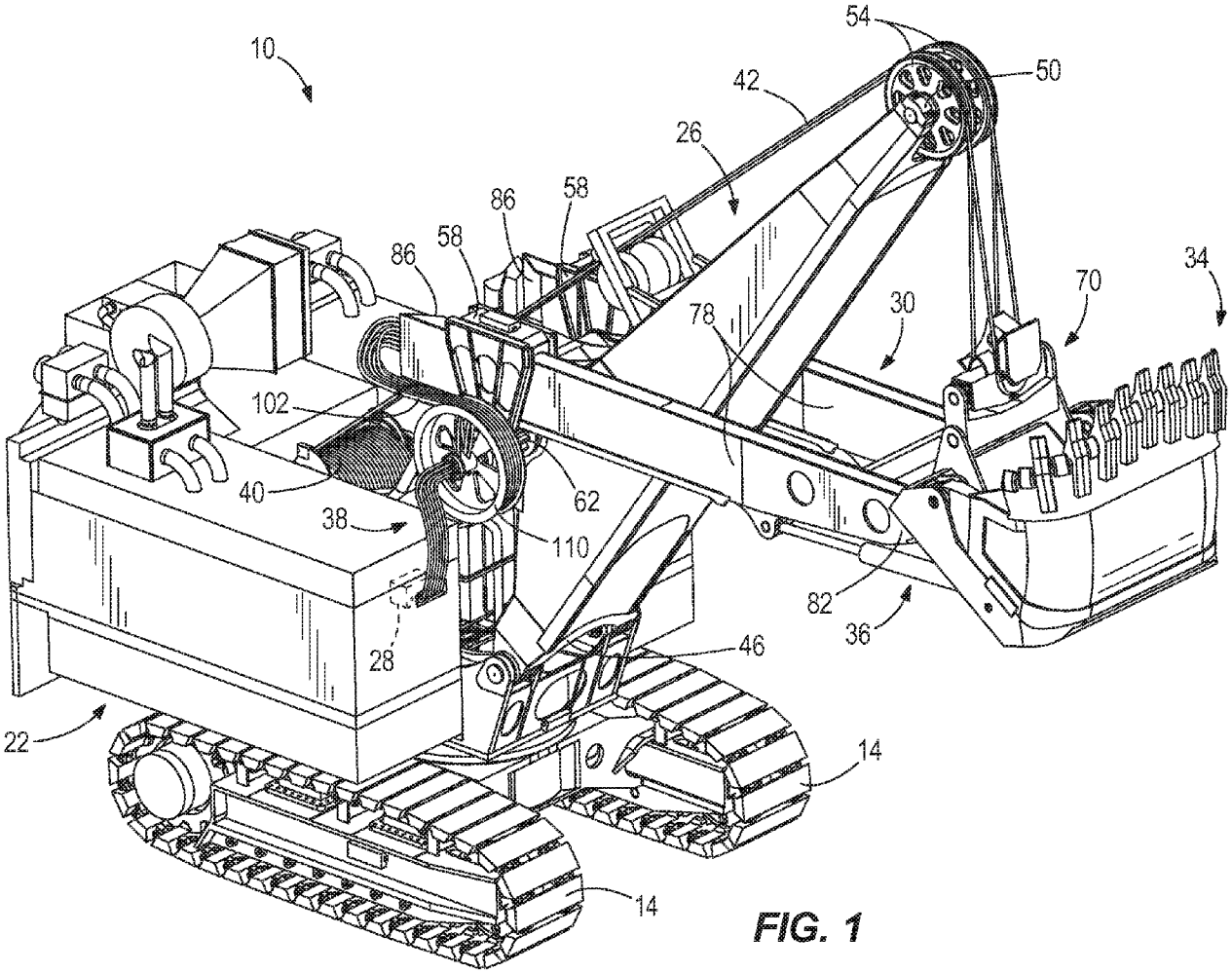
FIG. 1 is a perspective view of a shovel.

As shown in FIG. 1, a mining shovel 10 is supported by tracks 14 on a support surface or ground (not shown). The shovel 10 includes a frame 22 supporting a boom 26 and a fluid source 28 (e.g., a fluid pump or tank), an elongated member or handle 30, an attachment or bucket 34 including pivot actuators 36, and a fluid conveyance system 38. The frame 22 includes a rotational structure for rotating about an axis of rotation (not shown) that is generally perpendicular to a plane corresponding to a grade of the support surface. The frame 22 also includes a hoist drum 40 for reeling in and paying out a cable or hoist rope 42.

Figure 2:
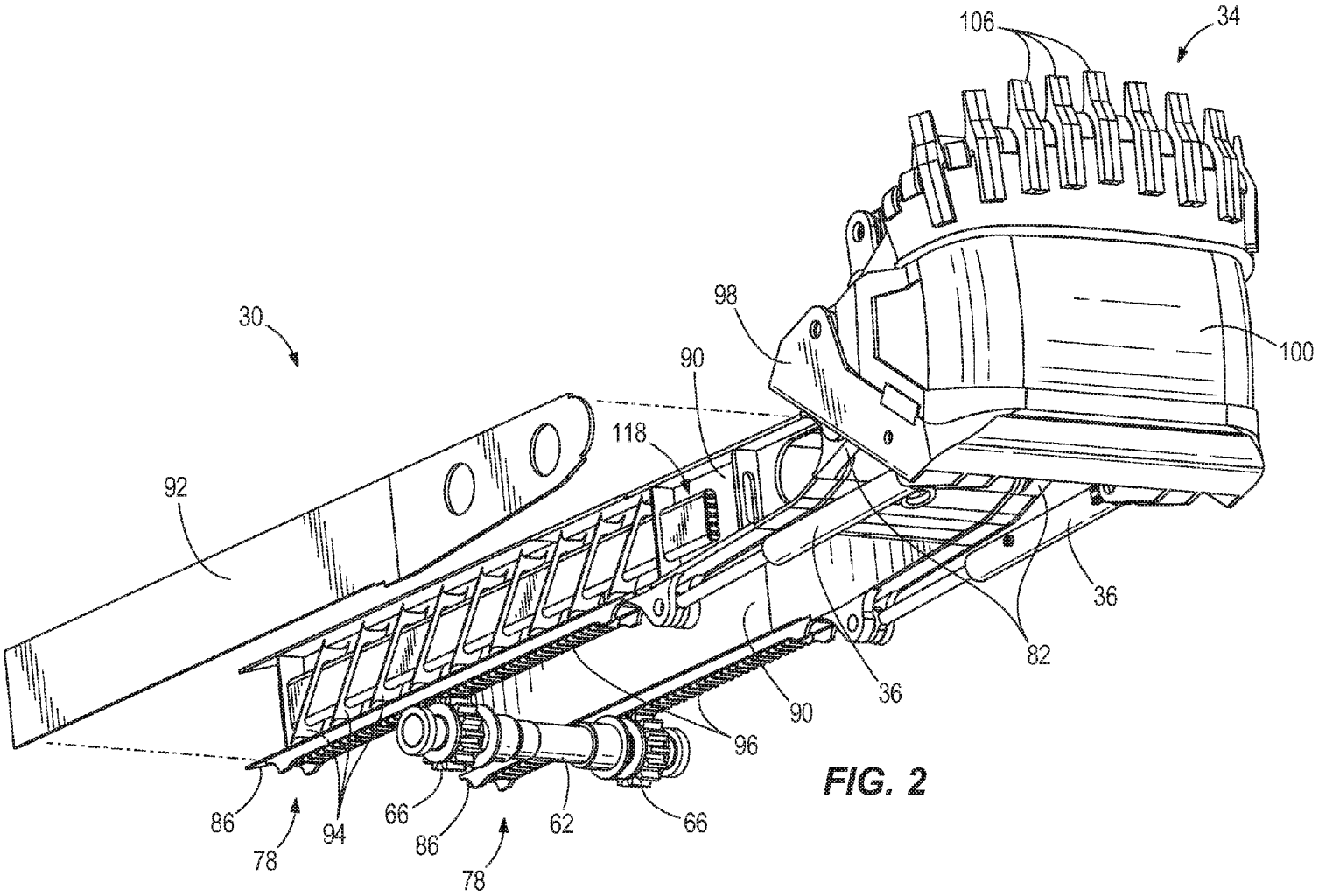
FIG. 2 is a perspective view of a handle and a bucket, with a side of the handle exploded.

The boom 26 includes a first end 46 coupled to the frame 22, a second end 50 opposite the first end 46, a boom sheave 54, saddle blocks 58, and a shipper shaft 62. The boom sheave 54 is coupled to the second end 50 of the boom 26 and guides the rope 42 over the second end 50. The rope 42 is coupled to the bucket 34 by a bail 70, and the bucket 34 is raised or lowered as the rope 42 is reeled in or paid out, respectively, by the hoist drum 40. The shipper shaft 62 extends through the boom 26 and is positioned between the first end 46 and the second end 50 of the boom 26. In the illustrated embodiment, the shipper shaft 62 is rotatable about an axis defined by the shipper shaft 62 and is oriented transverse to a longitudinal axis of the boom 26. The shipper shaft 62 includes pinions 66 (FIG. 2). The saddle block 58 is rotatably coupled to the boom 26 by the shipper shaft 62. In one embodiment, the saddle block 58 is a three-piece saddle block having two parallel side portions and a top portion extending between the side portions.

The handle 30 includes a pair of parallel arms 78 and defines a first end 82 and a second end 86. The first end 82 is pivotably coupled to the bucket 34. The second end 86 is movably received in the saddle block 58, which is rotatable relative to the boom 26 about the shipper shaft 62. The handle arms 78 are positioned on either side of the boom 26 and movably pass through each saddle block 58 such that the handle 30 is capable of rotational and translational movement relative to the boom 26. Stated another way, the handle 30 is linearly extendable relative to the saddle block 58 and is rotatable about the shipper shaft 62.

Referring to FIG. 2, each handle arm 78 includes a first side 90 proximate the boom 26 (FIG. 1), a second side 92 opposite the first side 90, and brackets 94 extending between the first side 90 and the second side 92. Each handle arm 78 also includes a rack 96 for engaging the pinion 66 of the shipper shaft 62, forming a rack-and-pinion coupling between the handle 30 and the boom 26. Rotation of the shipper shaft 62 about its axis moves the rack 96 along the shipper shaft 62, facilitating translational movement of the handle 30 relative to the boom 26 (FIG. 1). In the illustrated embodiment, the handle arms 78 are substantially straight. In other embodiments, the arms 78 may include a curved or angled portion, or another construction.

In the embodiment shown in FIG. 2, the bucket 34 is a clamshell-type bucket 34 having a rear wall 98 and a main body 100 that can be separated from the rear wall 98 to empty the contents of the bucket 34. The main body 100 may be actuated by one or more bucket cylinders (not shown). In other embodiments, the shovel 10 may include other types of attachments, buckets, or dippers. The bucket 34 includes teeth 106 and is used to excavate the desired work area, collect material, and transfer the collected material to a desired location (e.g., a material handling vehicle). Each pivot actuator 36 is coupled between the bucket 34 and the handle 30. The pivot actuators 36 actively control the pitch of the bucket 34 (i.e., the angle of the bucket 34 relative to the handle 30) by rotating the bucket 34 about the handle first end 82. In the illustrated embodiment, the pivot actuators 36 are hydraulic cylinders.

Referring again to FIG. 1, the fluid conveyance system 38 provides fluid communication between the fluid source 28 and the pivot actuators 36 on the first end 82 of the handle 30. In the illustrated embodiment, the fluid conveyance system 38 includes a hose portion 102 and a reel assembly 110 for supporting the hose portion 102 as the handle 30 moves relative to the boom 26. The hose portion 102 is wrapped onto the reel assembly 110 and is routed to the second end 86 of the handle arm 78. The reel assembly 110 maintains the proper amount of slack in the hose portion 102. In some embodiments, a fluid conveyance system 38 is positioned on each side of the handle 30, and a hose portion 102 is routed into the second end 86 of each arm 78.

In the illustrated embodiment, the reel assembly 110 includes a rotary union coupled to a reel as shown and described in U.S. patent application Ser. No. 13/866,717, filed Apr. 19, 2013, the entire contents of which is hereby incorporated by reference. In other embodiments, the reel assembly 110 may include a first reel and a second reel as shown and described in U.S. patent application Ser. No. 14/033,428, filed Sep. 20, 2013, the entire contents of which is hereby incorporated by reference. In still other embodiments, the hose portion 102 may be supported by an articulating linkage as shown and described in U.S. Provisional Application No. 61/789,361, filed Mar. 15, 2013, the entire contents of which is incorporated by reference. In further embodiments, the hose portion 102 may be free-hanging (i.e., unsupported).

Figure 3:
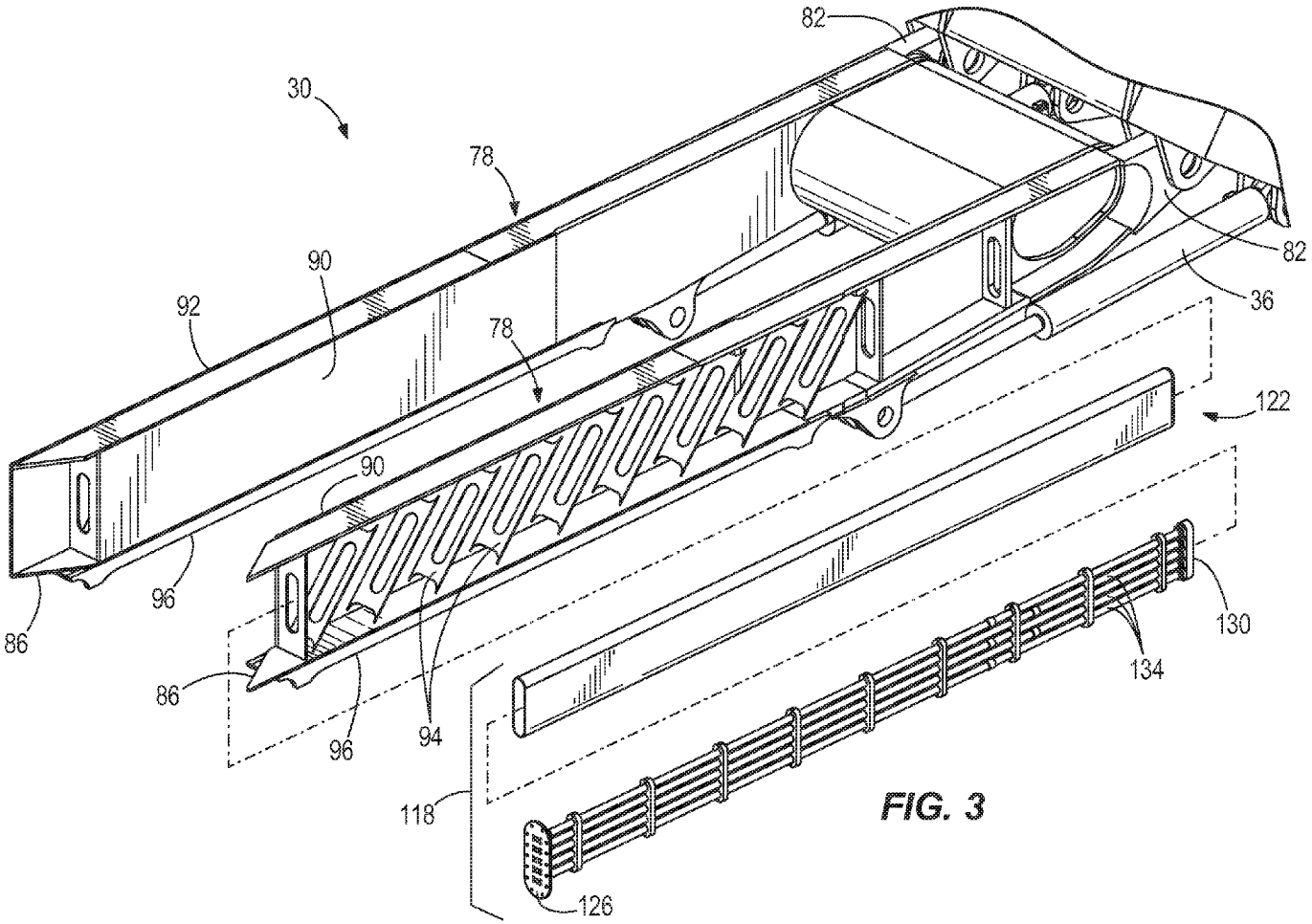
FIG. 3 is an exploded perspective view of the handle of FIG. 2 and a cartridge.

Referring to FIGS. 2 and 3, the shovel 10 further includes a cartridge 118 that is removably positioned within one of the handle arms 78. In the illustrated embodiment, the cartridge 118 is slidably inserted into one of the handle arms 78 from the second end 86 toward the first end 82 and is supported by the brackets 94 within the arm 78.

Figure 4:
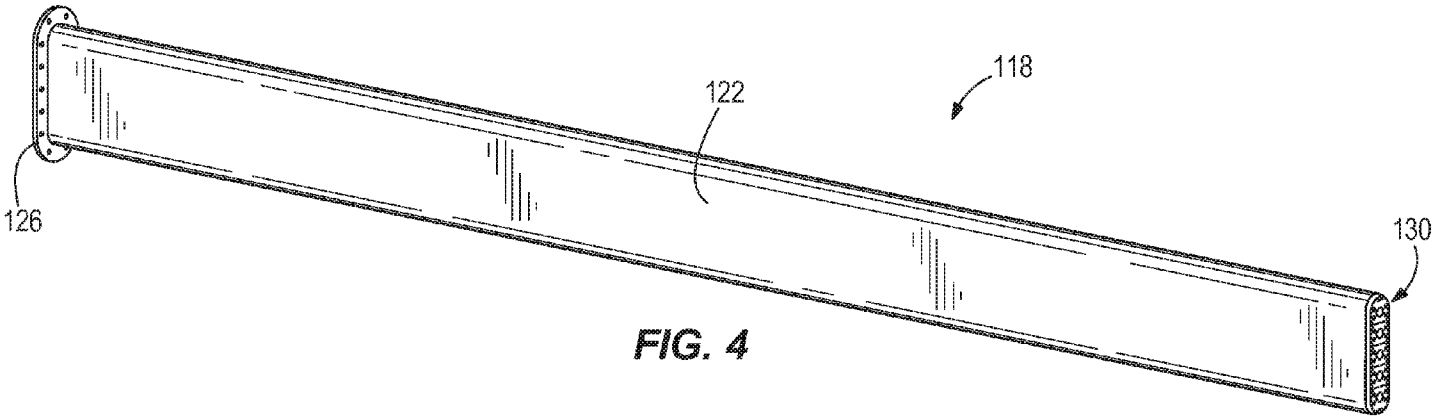
FIG. 4 is a perspective view of the cartridge of FIG. 3.

As shown in FIGS. 3 and 4, the cartridge 118 includes a housing 122, a first manifold or flange 126, a second manifold or nose portion 130, and conduits 134 (FIG. 3) extending through the housing 122 from one end to the other end. In the illustrated embodiment, the cartridge 118 has an elongated shape and defines a longitudinal cartridge axis. The flange 126 is positioned on one end of the cartridge 118 and the nose portion 130 is positioned on an opposite end of the cartridge 118. In the illustrated embodiment, the nose portion 130 of the cartridge 118 is inserted into the second end 86 of the handle arm 78 (FIG. 3) first such that the flange 126 is positioned proximate the second end 86 and the nose portion 130 is positioned proximate the first end 82. The flange 126 is coupled to the handle arm 78 (e.g., by fasteners).

Figure 5:
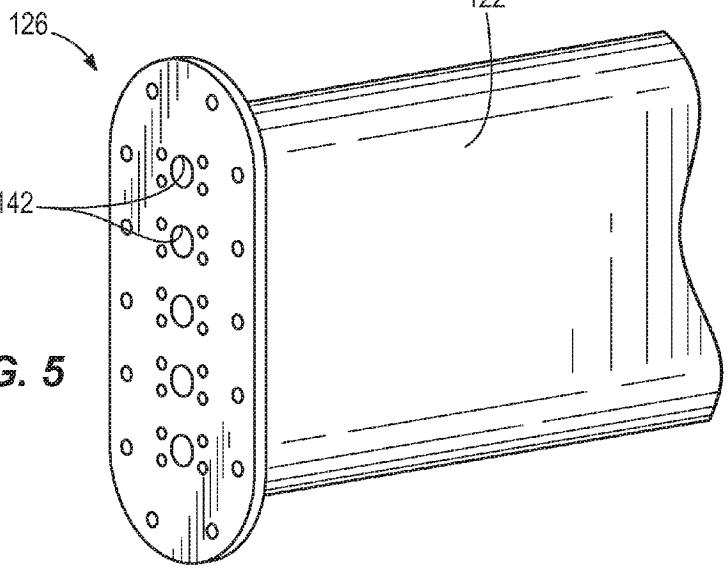
FIG. 5 is an enlarged perspective view of one end of the cartridge of FIG. 4.
Figure 6:
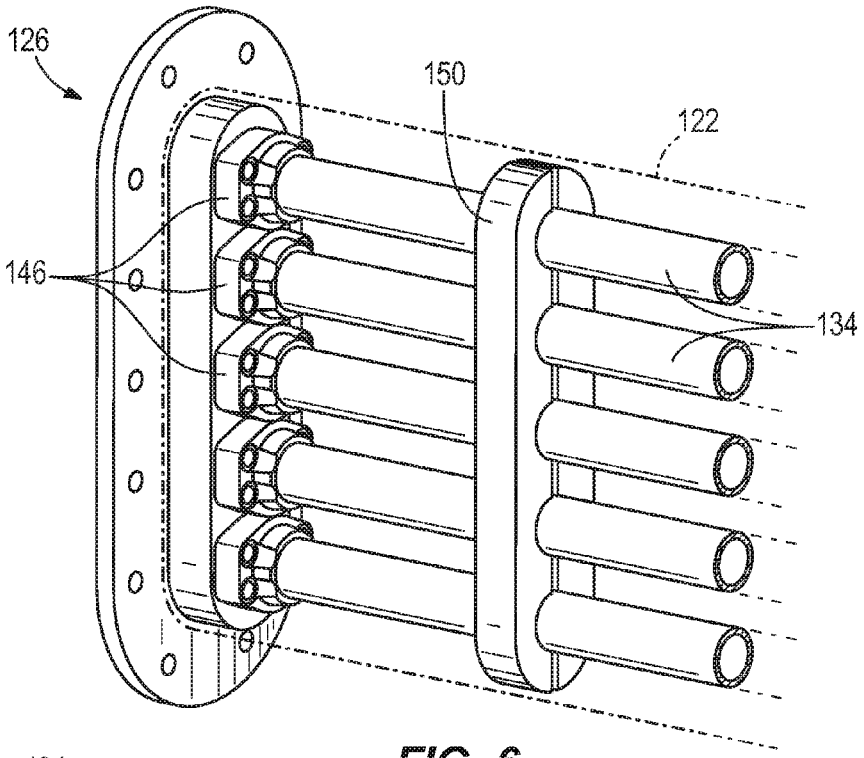
FIG. 6 is a reverse perspective view of the cartridge end of FIG. 5.

As shown in FIGS. 5 and 6, the flange 126 includes multiple ports 142 (FIG. 5) coupled to the hose portion 102 (FIG. 1) that is routed to the second end 86 of the handle arm 78. The ports 142 provide fluid communication between the hose portion 102 and the conduits 134 (FIG. 6) positioned within the housing 122. Each conduit 134 is secured to the flange 126 by a coupler 146 (FIG. 6) mating with one of the ports 142 to allow fluid to pass through. The conduits 134 are disposed in a generally parallel configuration and are supported by isolators 150 positioned at regular intervals. The isolators 150 minimize the effects of vibration and wear while routing the fluid through the handle 30. In the illustrated embodiment, the cartridge 118 includes five conduits 134. In other embodiments, the cartridge 118 may include fewer or more conduits 134.

Figure 7:
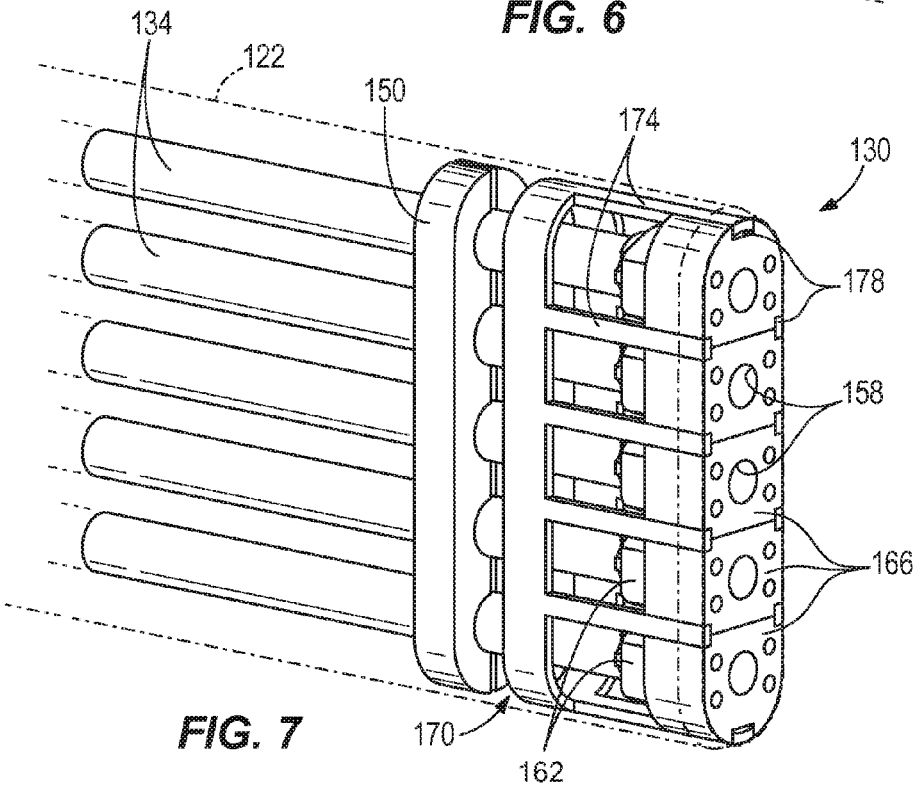
FIG. 7 is perspective view of another end of the cartridge of FIG. 4.

Referring to FIG. 7, the nose portion 130 includes multiple ports 158 that are in fluid communication with lines (not shown) providing fluid to the pivot actuators 36. The ports 158 provide fluid communication between the lines and the conduits 134 positioned within the housing 122. Each conduit 134 is secured to the nose portion 130 by a coupler 162 mating with one of the ports 158 to allow fluid to pass through. In the illustrated embodiment, the nose portion 130 is formed as multiple separate blocks 166, each of which includes a port 158. The nose portion 130 also includes a cage 170 having fingers 174. In the illustrated embodiment the fingers 174 extend parallel to the conduits 134 and are positioned in grooves 178 formed on the blocks 166. The fingers 174 provide a bearing surface along which the grooves 178 of the blocks 166 move. When pressurized fluid flows through the conduits 134, the length of the conduits 134 may change. The separate blocks 166 allow for variations in the length of the conduits 134 due to pressurization, and also account for variations in the manufacturing and assembly of the conduits 134. The fingers 174 provide bearing surfaces to maintain the relative positional alignment between the conduits 134.

The cartridge 118 consolidates multiple fluid conduits 134 and conveys fluid between the first end 82 and the second end 86 of the handle 30. The cartridge 118 manages the position and magnitude of the loads applied on the conduits 134. The cartridge 118 also isolates the conduits 134 from the handle 30. In addition, the conduits 134 are positioned on an interior portion of the handle 30, reducing the conduits' exposure to debris or other components that may break one of the conduits 134. The cartridge 118 can be easily removed and/or replaced, allowing for simpler maintenance and also allowing the cartridge 118 to be substituted with another cartridge 118 having a different configuration of conduits (e.g., different types of conduits for different fluids and/or different pressures). In one embodiment, each conduit 134 conveys a different type of fluid at a different pressure and flow rate from the other conduits 134.

In the illustrated embodiment, the conduits 134 supply pressurized fluid to the pivot actuators 36 for pivoting the bucket 34 relative to the handle 30. In other embodiments, at least one of the conduits 134 may supply fluid to the bucket actuators for pivoting the main body 102 relative to the rear wall 98. In other embodiments, at least one of the conduits 134 is in fluid communication with one or more various mechanical connections on the bucket 34 and the handle 30 and provides lubricative fluid to the connections. The lubricative fluid may be a liquid, solid, and/or semi-solid (e.g., grease). The conduits 134 may convey both lubricative fluid and hydraulic fluid. In still other embodiments, the cartridge 118 may be adapted to include parallel electrical and signal conduits to provide electrical communication between components on the frame 22 and components positioned near the first end 82 of the handle 30.

Thus, the invention provides, among other things, a fluid conveyance cartridge. Although the invention has been described in detail with reference to certain preferred embodiments, variations and modifications exist within the scope and spirit of one or more independent aspects of the invention as described. Various features and advantages of the invention are set forth in the following claims.

What is claimed is:

1. An industrial machine comprising:

a frame including a boom and a fluid source;

an elongated member movably coupled to the boom, the member including a first end and a second end;

an attachment pivotably coupled to the first end of the elongated member;

a plurality of fluid lines coupled to the second end of the elongated member and in fluid communication with the fluid source; and a cartridge removably coupled to the elongated member, the cartridge including a housing and a plurality of conduits supported within the housing, the plurality of conduits in fluid communication with the plurality of fluid lines.

2. The industrial machine of claim 1, wherein the elongated member includes an arm having a first side and a second side opposite the first side, and wherein the cartridge is positioned between the first side and the second side.

3. The industrial machine of claim 2, wherein the cartridge is slidable between the first side and the second side of the arm, and at least one end of the cartridge is coupled to the elongated member.

4. The industrial machine of claim 1, wherein the cartridge includes at least one support member positioned within the housing and supporting the conduits relative to one another.

5. The industrial machine of claim 1, wherein the cartridge is slidably inserted into the elongated member from the second end of the elongated member toward the first end of the elongated member.

6. The industrial machine of claim 1, wherein the cartridge includes a first end, a second end, and a manifold positioned proximate the first end, the manifold including multiple ports, each port in communication with one of the conduits.

7. The industrial machine of claim 1, wherein the elongated member is supported for pivoting movement relative to the boom and supported for translational movement relative to the boom, the elongated member defining a constant length between the first end and the second end, wherein the cartridge is secured relative to the elongated member during movement of the elongated member.

8. The industrial machine of claim 1, wherein the cartridge includes a first end and a second end, the cartridge defining a cartridge length between the first end and the second end, each of the plurality of conduits having a conduit length substantially equal to the cartridge length.

9. An industrial machine comprising:

a frame including a boom;

an elongated member movably coupled to the boom, the member including a first end and a second end and defining a longitudinal axis therebetween;

a plurality of lines coupled to the second end of the elongated member; and a cartridge removably coupled to the elongated member, the cartridge including a housing and a plurality of conduits supported within the housing, the plurality of conduits in communication with the plurality of lines.

10. The industrial machine of claim 9, wherein the cartridge is coupled to the elongated member by moving the cartridge relative to the elongated member parallel to the longitudinal axis.

11. The industrial machine of claim 9, wherein the cartridge includes at least one support member positioned within the housing and supporting the conduits relative to one another.

12. The industrial machine of claim 9, wherein at least one of the lines is in fluid communication with a fluid source, and wherein at least one of the conduits provides fluid communication between the at least one line and an attachment.

13. The industrial machine of claim 9, wherein the elongated member includes a first side and a second side opposite the first side, and wherein the cartridge is positioned between the first side and the second side.

14. The industrial machine of claim 13, further comprising an attachment supported by the elongated member proximate the first end, and wherein the cartridge housing includes a first end and a second end and the conduits extend between the first end and the second end of the housing, wherein the cartridge is coupled to the elongated member by inserting the first end of the cartridge housing into the second end of the elongated member and moving the cartridge toward the first end of the elongated member.

15. The industrial machine of claim 14, wherein the cartridge includes a manifold positioned proximate the first end of the cartridge, the manifold including multiple ports, each port in communication with one of the conduits.

16. The industrial machine of claim 9, wherein the elongated member is supported for pivoting movement relative to the boom and supported for translational movement relative to the boom, the elongated member defining a constant length between the first end and the second end, wherein the cartridge is secured relative to the elongated member during movement of the elongated member.

17. The industrial machine of claim 9, wherein the cartridge includes a first end and a second end, the cartridge defining a cartridge length between the first end and the second end, each of the plurality of conduits having a conduit length substantially equal to the cartridge length.

18. An attachment support member for an industrial machine, the support member movably coupled to a frame member, the support member comprising:

an arm including a first end and a second end, the first end configured to be pivotably coupled to an attachment, the arm supported for at least translational movement;

a cartridge removably coupled to the arm, the cartridge including a housing and a plurality of conduits, the housing having a first end and a second end, the cartridge remaining stationary relative to the first end of the arm and relative to the second end of the arm while the arm translates, the conduits extending between the first end and the second end of the housing, each end of the housing including a manifold having multiple ports, each port in communication with one of the conduits.

19. The attachment support member of claim 18, wherein the arm defines an axis between the first end and the second end, wherein the cartridge is coupled to the arm by moving the cartridge relative to the arm parallel to the longitudinal axis.

20. The attachment support member of claim 18, wherein the arm includes a first side and a second side opposite the first side, wherein the cartridge is supported between the first side and the second side.

21. The attachment support member of claim 18 wherein the cartridge includes at least one support member positioned within the housing and supporting the conduits relative to one another.

22. The attachment support member of claim 18, wherein at least one of the conduits is in fluid communication with a fluid source and conveys a fluid between the first end of the arm and the second end of the arm.

23. The attachment support member of claim 18, wherein the first end of the arm is configured to be coupled to an attachment, and wherein the cartridge is coupled to the arm by inserting the first end of the cartridge housing into the second end of the arm and moving the cartridge toward the first end of the arm.

24. The attachment support member of claim 18, wherein the housing defines a housing length between the first end of the housing and the second end of the housing, each of the plurality of conduits having a conduit length substantially equal to the housing length.

* * * * *